US007135004B2

(12) United States Patent
Hsu

(10) Patent No.: US 7,135,004 B2
(45) Date of Patent: Nov. 14, 2006

(54) ROTARY MASSAGING STICK

(76) Inventor: Yu Hsu, 2F, No. 17, Lane 39, Chi Lung Road, Sec. 2, Taipei (TW)

( * ) Notice: Subject to any disclaimer, the term of this patent is extended or adjusted under 35 U.S.C. 154(b) by 275 days.

(21) Appl. No.: 10/930,818

(22) Filed: Sep. 1, 2004

(65) Prior Publication Data

US 2006/0047181 A1 Mar. 2, 2006

(51) Int. Cl.
*A61H 15/00* (2006.01)

(52) U.S. Cl. ..... 601/112; 601/113

(58) Field of Classification Search ..... 601/112–113; 600/38

See application file for complete search history.

(56) References Cited

U.S. PATENT DOCUMENTS

| | | | | |
|---|---|---|---|---|
| 6,402,710 | B1 * | 6/2002 | Hsu | 601/113 |
| 6,764,454 | B1 * | 7/2004 | Tu | 601/15 |
| 2004/0133134 | A1 * | 7/2004 | Polychronis | 601/113 |

* cited by examiner

*Primary Examiner*—Michael A. Brown
(74) *Attorney, Agent, or Firm*—Rosenberg, Klein & Lee

(57) ABSTRACT

A rotary massaging stick having rotary massaging ball assemblies rotatable in reversed directions by a motor through a transmission gear train for stimulating the G point in the vagina of a woman to cause the woman to reach the climate of sexual excitement.

1 Claim, 7 Drawing Sheets

ROTARY MASSAGING STICK

BACKGROUND OF THE INVENTION

1. Field of the Invention

The present invention relates generally to a rotary massaging stick and more particularly, to such a rotary massaging stick, which is practical for simulating the G point in the vagina of a woman to reach the climate of sexual excitement.

2. Description of the Related Art

Various sex toys have been disclosed for helping people to reach the climate of sexual excitement, and have appeared on the market. A conventional rotary massaging stick for this purpose has rotary massaging ball assemblies that can be rotated in one specific direction to stimulate the vagina. However, a sex toy of this design is less attractive to consumers because the rotary massaging ball assemblies can be rotated in one specific direction only.

SUMMARY OF THE INVENTION

The present invention has been accomplished under the circumstances in view. It is the main object of the present invention to provide a rotary massaging stick, which drives rotary massaging ball assemblies to rotate in reversed directions to stimulate the G point in the vagina of a woman, causing the woman to reach the climate of sexual excitement.

DETAILED DESCRIPTION OF THE INVENTION

Figure 1:
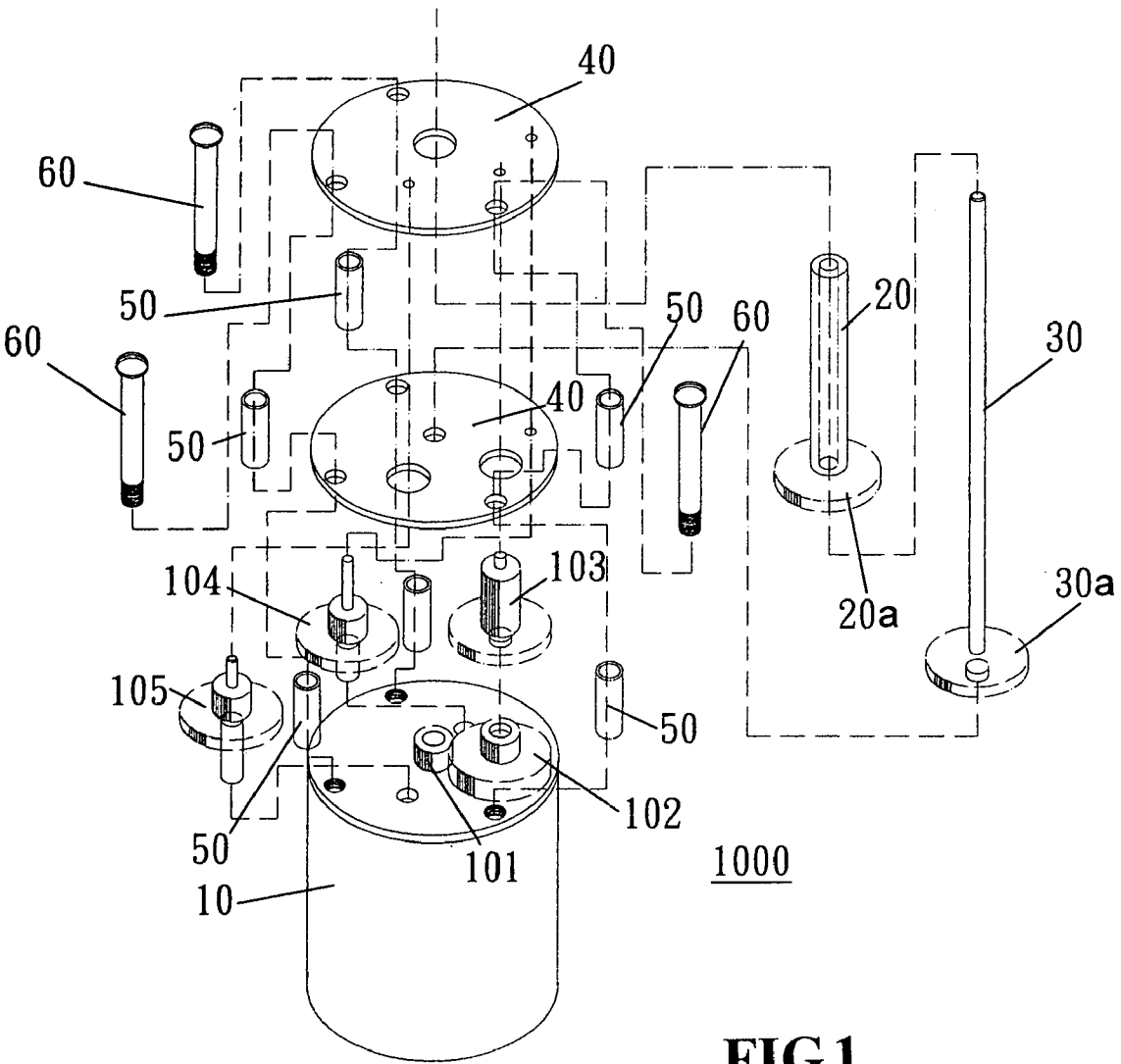
FIG. 1 is an exploded view of a transmission mechanism for a rotary massaging stick according to the present invention.
Figure 2:
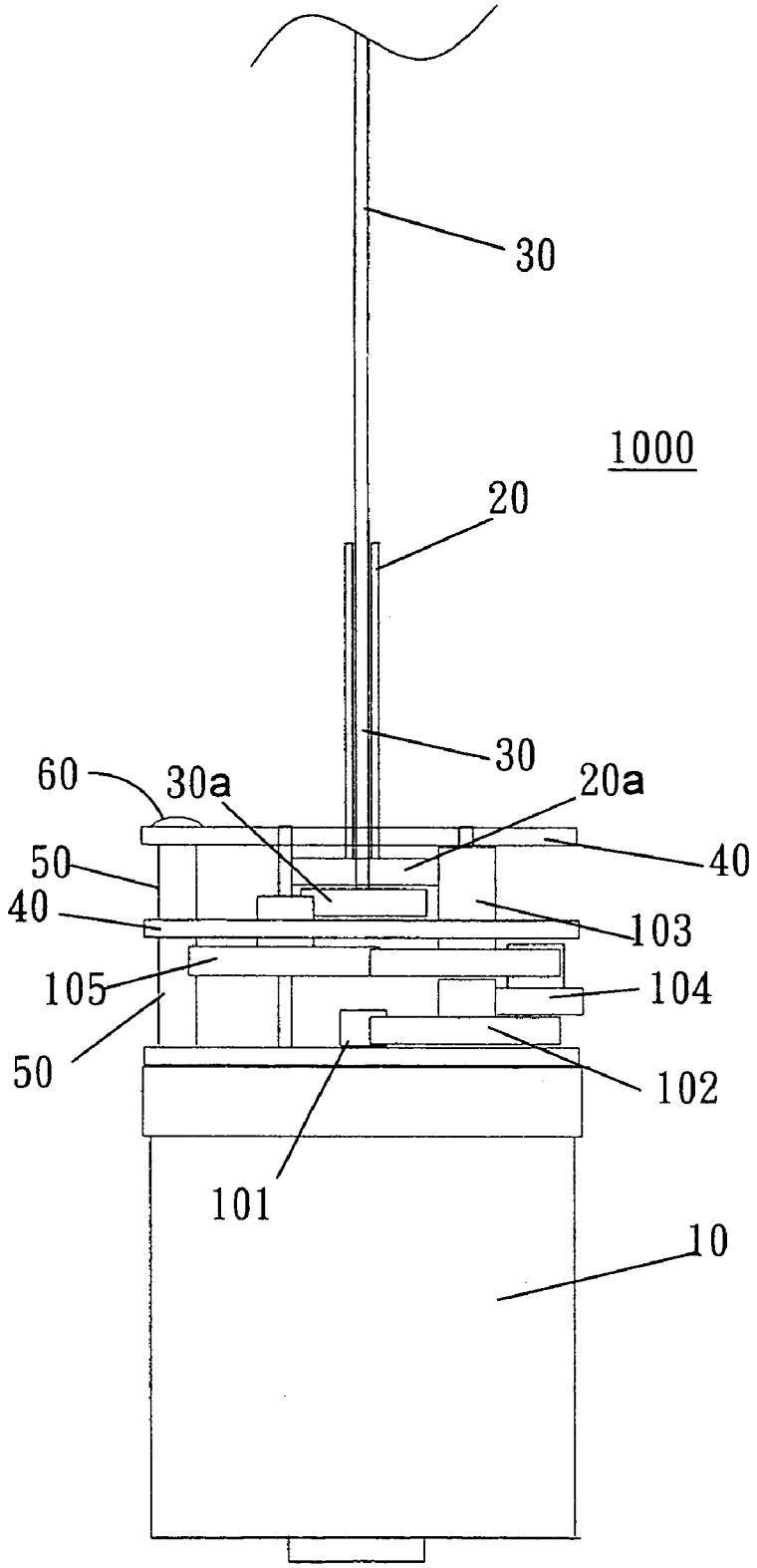
FIG. 2 is a side view showing the transmission mechanism assembled according to the present invention.
Figure 3:
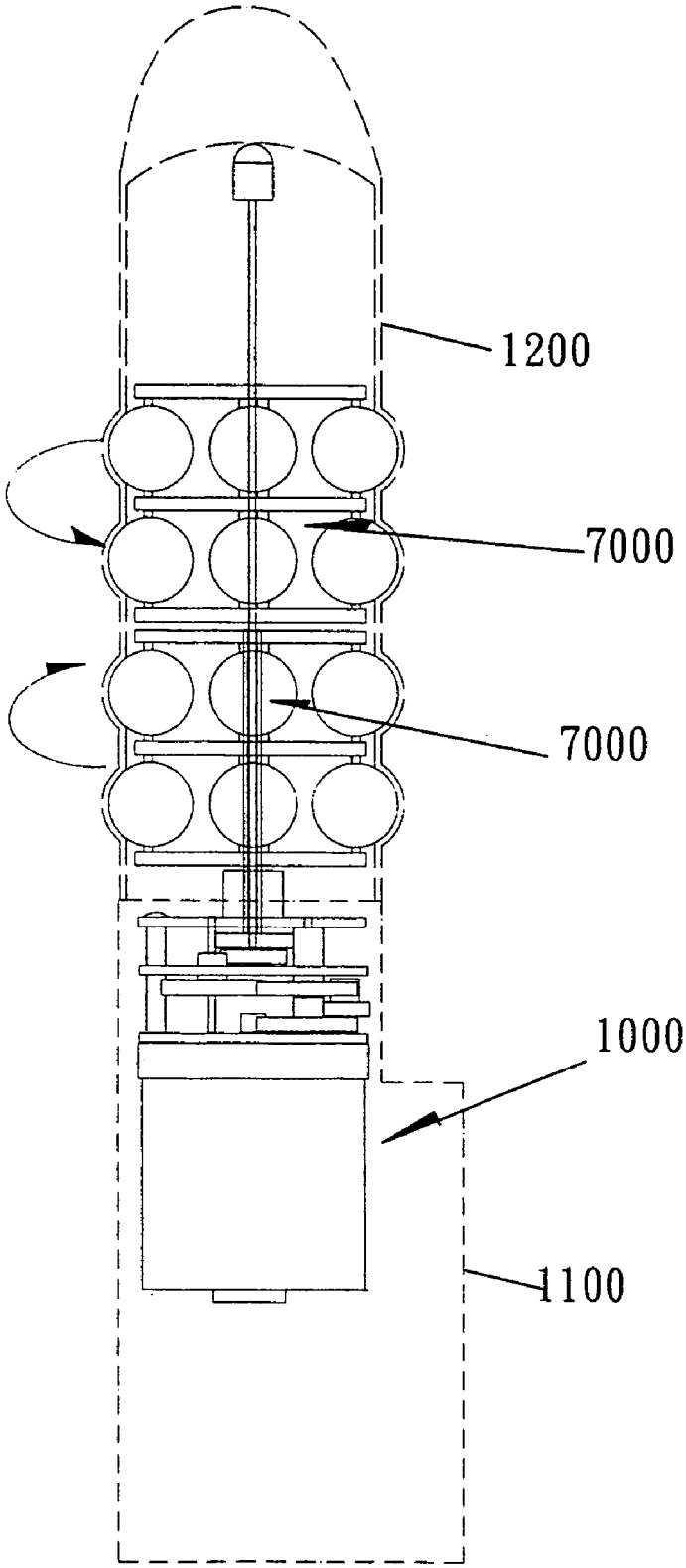
FIG. 3 is a schematic drawing of the present invention showing the rotary massaging stick in action.

Referring to FIGS. 1~3, a rotary massaging stick is shown comprising a transmission mechanism 1000. The transmission mechanism 1000 comprises a motor 10, a plurality of circular mounting plates 40 fastened to the housing of the motor 10 at different elevations with spacer tubes 50 and screw bolts 60, a stepped gear A 102 meshed with the pinion 101 at the output shaft of the motor 10, a stepped gear B 103 fixedly connected in parallel to the stepped gear A 102, a stepped gear C 104 meshed with the stepped gear A 102 and the stepped gear B 103, a sleeve 20 rotatably mounted in one circular mounting plate 40 at the center, a first transmission gear 20*a* fixedly mounted on the sleeve 20 and meshed with the stepped gear B 103, a transmission shaft 30 inserted through the sleeve 20, a second transmission gear 30*a* fixedly mounted on the bottom end of the transmission shaft 30, and a stepped gear D 105 meshed between the second transmission gear 30*a* and the stepped gear B 103. Massaging ball assemblies 7000 and a flexible conical cap 1200 are fastened to the sleeve 20 and the transmission shaft 30 (see FIG. 3).

Figure 4:
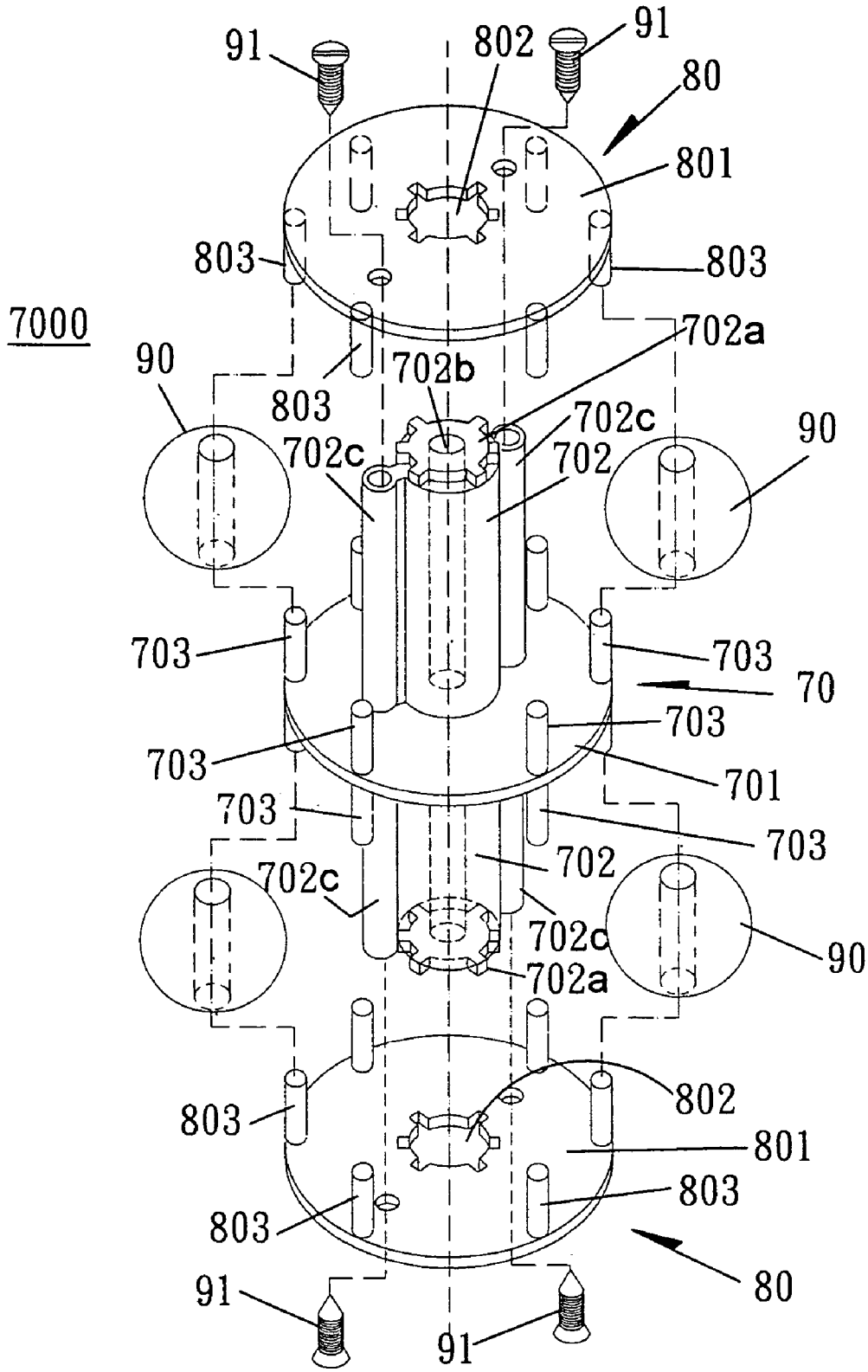
FIG. 4 is an exploded view of one massaging ball unit of the rotary massaging stick according to the present invention.
Figure 5:
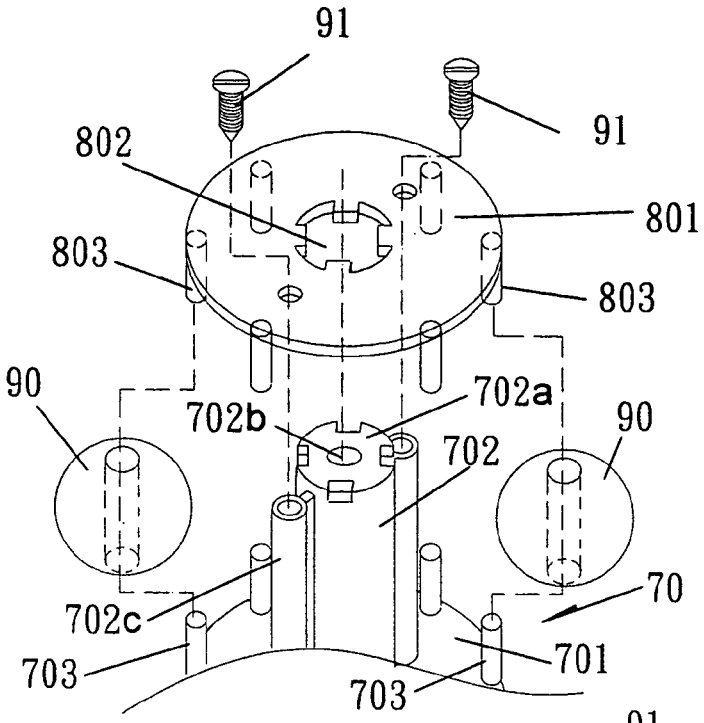
FIG. 5 is an exploded view showing an alternate form of the massaging ball unit according to the present invention.
Figure 5A:
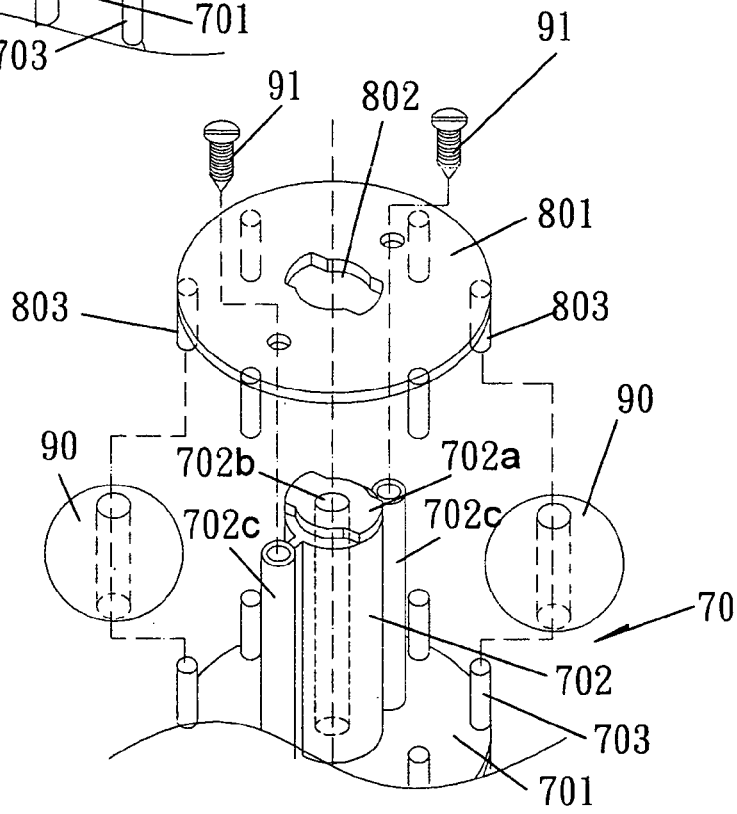
FIG. 5A is an exploded view showing another alternate form of the massaging ball unit according to the present invention.

Referring to FIGS. 4, 5A, and 5B, each massaging ball unit 7000 is comprised of a holder base 70, two locating devices 80, and a plurality of massaging balls 90. The holder base 70 comprises a flat circular plate member 701, a center bar 702 extended through the center of the circular plate member 701, two female screws 702*c* arranged in parallel to the center bar 702 at two sides, a plurality of pins 703 symmetrically perpendicularly provided at the top and bottom sides of the flat circular plate member 701 and equiangularly spaced around the border of the flat circular plate member 701 for supporting the massaging balls 90. The center bar 702 comprises a center axle hole 702*b* axially extended through the two distal ends, and two peripherally serrated engagement blocks 702*a* fixedly provided at the two distal ends around the center axle hole 702*b*. The locating devices 80 each comprise a flat circular plate member 801 fastened to one end of each of the female screws 702*c* by screws 91 and having a center coupling hole 802 coupled to one peripherally serrated engagement block 702*a*, and a plurality of pins 803 perpendicularly extended from the flat circular plate member 801 around the border and respectively inserted into the massaging balls 90 to hold the massaging balls 90 on the pins 703 of the holder base 70.

Referring to FIG. 3 again, the transmission mechanism 1000 is mounted in a controller 1100, which is orthopedically engineered for the holding of the hand.

Figure 7:
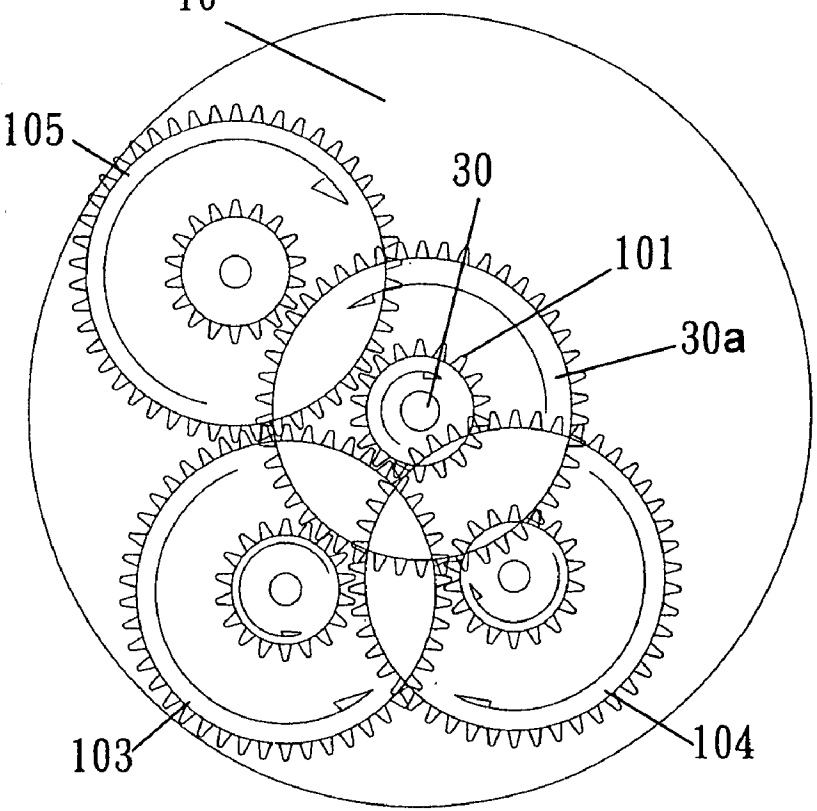
FIG. 7 is a schematic drawing showing the sleeve of the transmission mechanism set for counter-clockwise rotation.
Figure 6:
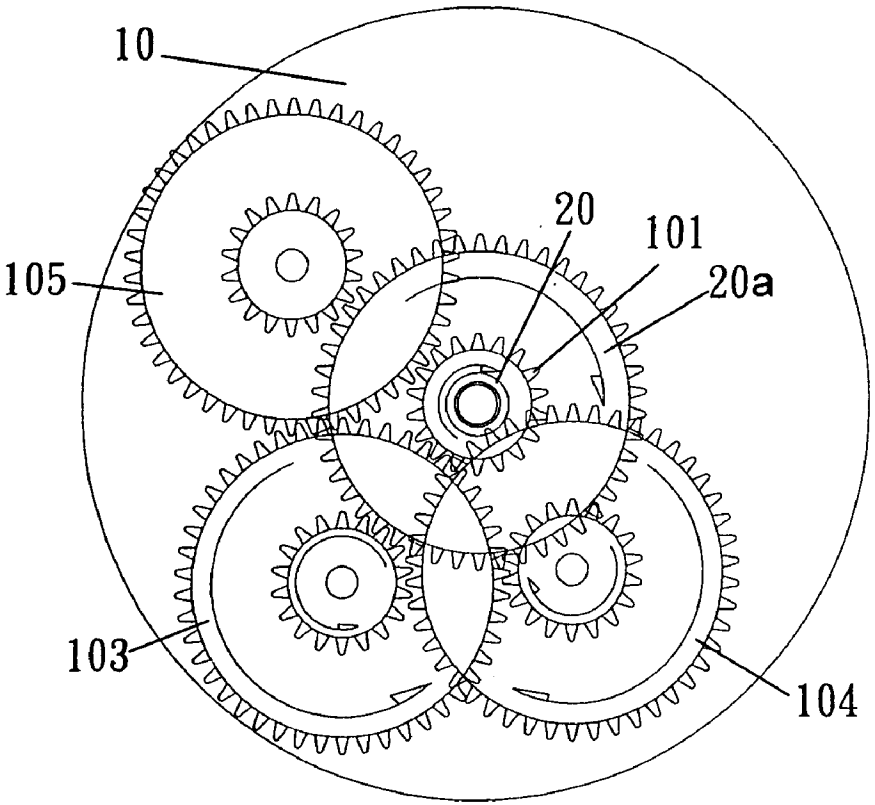
FIG. 6 is a schematic drawing showing the sleeve of the transmission mechanism set for clockwise rotation.
Figure 8:
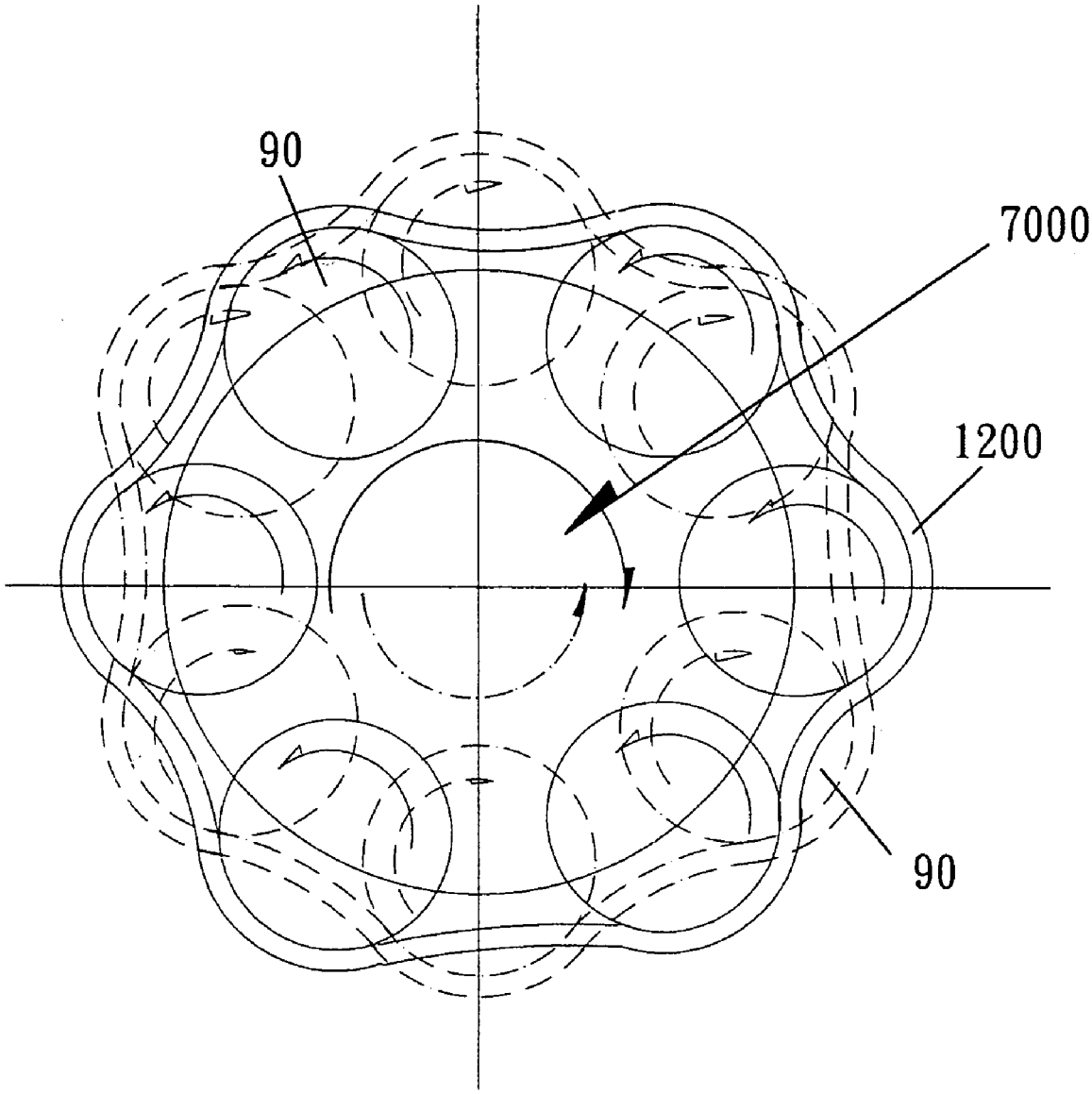
FIG. 8 is a schematic drawing of the present invention, showing two massaging ball assemblies rotated in reversed directions.

Referring to FIGS. 6~8 and FIG. 2 again, when in use, operate the controller 1100 to start the motor 10, thereby causing the pinion 101 to rotate the gears 102~105, and therefore the first transmission gear 20*a* and the second transmission gear 30*a* are driven to rotate the sleeve 20 and the transmission shaft 30 in reversed directions. During respective rotary motion of the sleeve 20 and the transmission shaft 30, the massaging ball assemblies 7000 and the flexible conical cap 1200 are respectively rotated with the sleeve 20 and the transmission shaft 30 to provide a massaging effect.

What is claimed is:

1. A rotary massaging stick comprising:

a transmission mechanism, said transmission mechanism comprising a motor, said motor having an output shaft and a pinion fixedly mounted on said output shaft, a plurality of circular mounting plates fastened to a shell of said motor at different elevations with spacer tubes and screw bolts, a stepped gear (A) meshed with said pinion, a stepped gear (B) fixedly connected in parallel to said stepped gear (A), a stepped gear (C) meshed with said stepped gear (A) and said stepped gear (B), a sleeve rotatably mounted in one said circular mounting plate, a first transmission gear fixedly mounted on said sleeve and meshed with said stepped gear (B), a transmission shaft inserted through said sleeve, a second transmission gear fixedly mounted on a bottom end of said transmission shaft, and a stepped gear (D) meshed between said second transmission gear and said stepped gear (B);

a controller accommodating said transmission mechanism for controlling operation of said motor;

a flexible conical cap capped on one end of said transmission shaft remote from said controller; and a plurality of massaging ball assemblies fastened to said sleeve and said transmission shaft and spaced between said controller and said flexible conical cap, each said massaging ball unit comprising a holder base, two locating devices, and a plurality of massaging balls, said holder base comprising a flat circular plate member, a center bar extended through the center of the circular plate member, two female screws arranged in parallel to said center bar at two sides, a plurality of pins symmetrically perpendicularly provided at top and bottom sides of said flat circular plate member and equiangularly spaced around the border of said flat circular plate member for supporting said massaging balls, said center bar comprising a center axle hole axially extended through two distal ends thereof, and two peripherally serrated engagement blocks fixedly provided at the two distal ends around said center axle hole, said locating devices being fastened to said female screws by screws, each said locating device comprising a center coupling hole respectively coupled to the peripherally serrated engagement blocks of said holder base and a plurality of pins respectively inserted into said massaging balls to hold said massaging balls on the pins of said holder base.

* * * * *